US006327944B1

(12) United States Patent
Liao

(10) Patent No.: US 6,327,944 B1
(45) Date of Patent: Dec. 11, 2001

(54) STRUCTURE OF PLIERS WITH VARIABLE NOSE

(76) Inventor: Wan Yi Liao, PO Box 82-144, Taipei (TW)

( * ) Notice: Subject to any disclaimer, the term of this patent is extended or adjusted under 35 U.S.C. 154(b) by 0 days.

(21) Appl. No.: 09/747,990

(22) Filed: Dec. 27, 2000

(51) Int. Cl.[7] ..... B25B 7/02
(52) U.S. Cl. ..... 81/418; 30/260; 72/409.16
(58) Field of Search ..... 81/418, 421, 423, 81/424.5, 426, 426.5; 72/409.16; 30/260

(56) References Cited

U.S. PATENT DOCUMENTS

| | | | | |
|---|---|---|---|---|
| 181,175 | * | 8/1876 | Huntoon | 81/418 |
| 2,725,774 | * | 12/1955 | Tekse | 81/423 |
| 2,745,177 | * | 5/1956 | Kortick | 30/260 |
| 4,118,971 | * | 10/1978 | Izraeli | 72/409.16 |
| 4,249,308 | * | 2/1981 | Boyajian | 30/260 |
| 4,747,588 | * | 5/1988 | Dillhoff | 81/418 |
| 5,113,727 | * | 5/1992 | Foster | 81/423 |
| 5,157,837 | * | 10/1992 | Rose | 30/260 |
| 5,168,783 | * | 12/1992 | Shea | 81/424.5 |
| 5,187,968 | * | 2/1993 | Beetz et al. | 81/418 |
| 5,485,770 | * | 1/1996 | Poplak | 81/426.5 |
| 5,595,094 | * | 1/1997 | Negus | 81/426.5 |
| 5,913,933 | * | 6/1999 | Beetz et al. | 81/421 |

* cited by examiner

*Primary Examiner*—James G. Smith
*Assistant Examiner*—Hadi Shakeri
(74) *Attorney, Agent, or Firm*—A & J

(57) ABSTRACT

A structure of pliers with variable nose comprising a pliers body, two elongated arms being formed with the plier's body to form large nose pliers, the nose being mountable with a large diameter pliers, a small diameter pliers, a flat board pliers, a soft tube pliers, a pincher, a pressurized container pliers, wherein the two elongated arms are mounted with rivets at the top section of the pliers body and the elongated arms comprises of two identical shape clipping plates having provided with two symmetrical holes so that the rivets can be mounted therethrough to form into two clipping arms, wherein the clipping face of the clipping plate is provided with two groups of teeth and various type of clipping blocks with two recesses are mounted with a space formed by the two clipping plates and are secured with rivets, thereby a pliers with multifunction is formed.

4 Claims, 14 Drawing Sheets

STRUCTURE OF PLIERS WITH VARIABLE NOSE

BACKGROUND OF THE INVENTION (a) Field of the Invention

The present invention relates generally to a structure of pliers with variable nose, and in particular, the structure of a pliers nose, which can engage, and lock a tightening seat with various tightening functions.

(b) Description of the Prior Art

Conventional pliers have nose formed by curved jaws and pivot. However, normally, this component is fixed and rigid, and cannot be adjusted and serves with only one purpose. In application of these pliers, there are drawbacks for instance, the size of the nose is fixed and is not applicable to unlock or lock object or article with a larger diameter than the opened nose. FIG. 2 shows pliers with a large nose so as to solve the drawback of the above structure. However, in application of this design, both hands have to be used so as to hold the object with one hand in order to clip thereon and with the other hand holding the pliers. Due to its long handle of this conventional structure, it cannot only be used in a more spacious working environment. FIG. 3 is another conventional plier's structure with a sharp element to make a hole on a pressurized container. However, this structure provides only a single function to form a hole thereon.

Accordingly, it is an object of the present invention to provide a structure of pliers with variable nose, which can initiate the above drawbacks.

SUMMARY OF THE INVENTION

Accordingly, it is an object of the present invention to provide a structure of pliers with variable nose, wherein diameter of all sizes of tools can be gripped and clipped by the pliers so as to unlock or to lock an object.

An aspect of the present invention is to a structure of pliers with variable nose comprising a pliers body, two elongated arms being formed with the pliers body to form a large nose pliers, the nose being mountable with a large diameter pliers, a small diameter pliers, a flat board pliers, a soft tube pliers, a pincher, a pressurized container pliers, wherein the two elongated arms are mounted with rivets at the top section of the pliers body and the elongated arms comprises of two identical shape clipping plates having being provided with two symmetrical holes so that the rivets can be mounted therethrough to form into two clipping arms, wherein the clipping surface of the clipping plate is provided with two groups of teeth, and various types of clipping blocks with two recesses are mounted with a space formed by the two clipping plates and are secured with rivets, thereby a pliers with multifunction is formed.

Yet another object of the present invention to provide a structure of pliers with variable nose, wherein various types of noses can be formed on the pliers body to provide multiple function of locking and unlocking.

A further object of the present invention is to provide a structure of pliers with variable nose, wherein the pliers facilitates locking and unlocking by combining clipping block at the clipping arms of the pliers.

Yet a further object of the present invention is to provide a structure of pliers with variable nose, wherein the pliers is multi-functional and therefore special pliers for a special task are not required.

DETAILED DESCRIPTION OF THE PRESENT INVENTION

Figure 1:
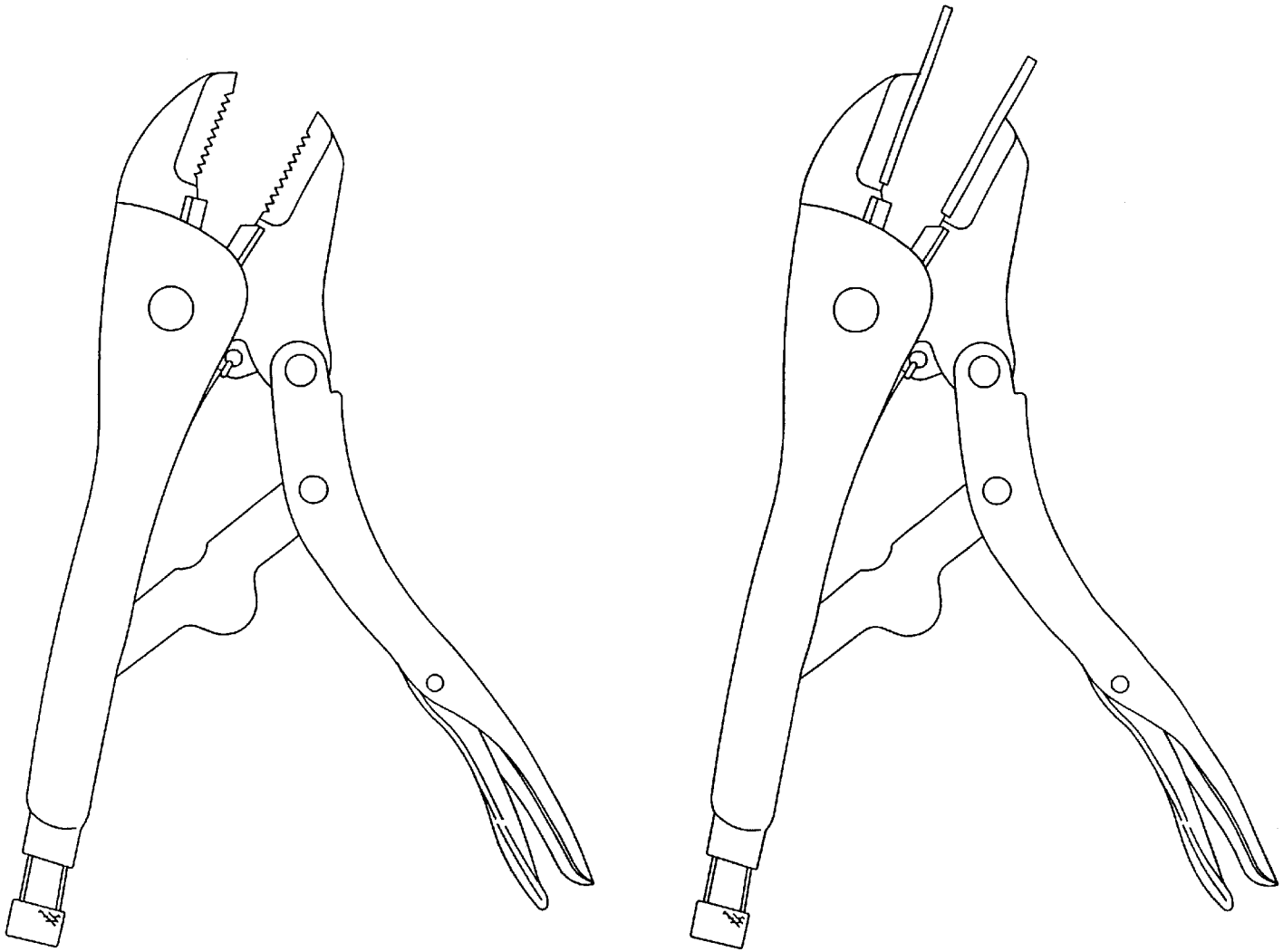
PRIOR ART FIG.1
FIG. 1 is a perspective view of conventional pliers with various jaws.
Figure 2:
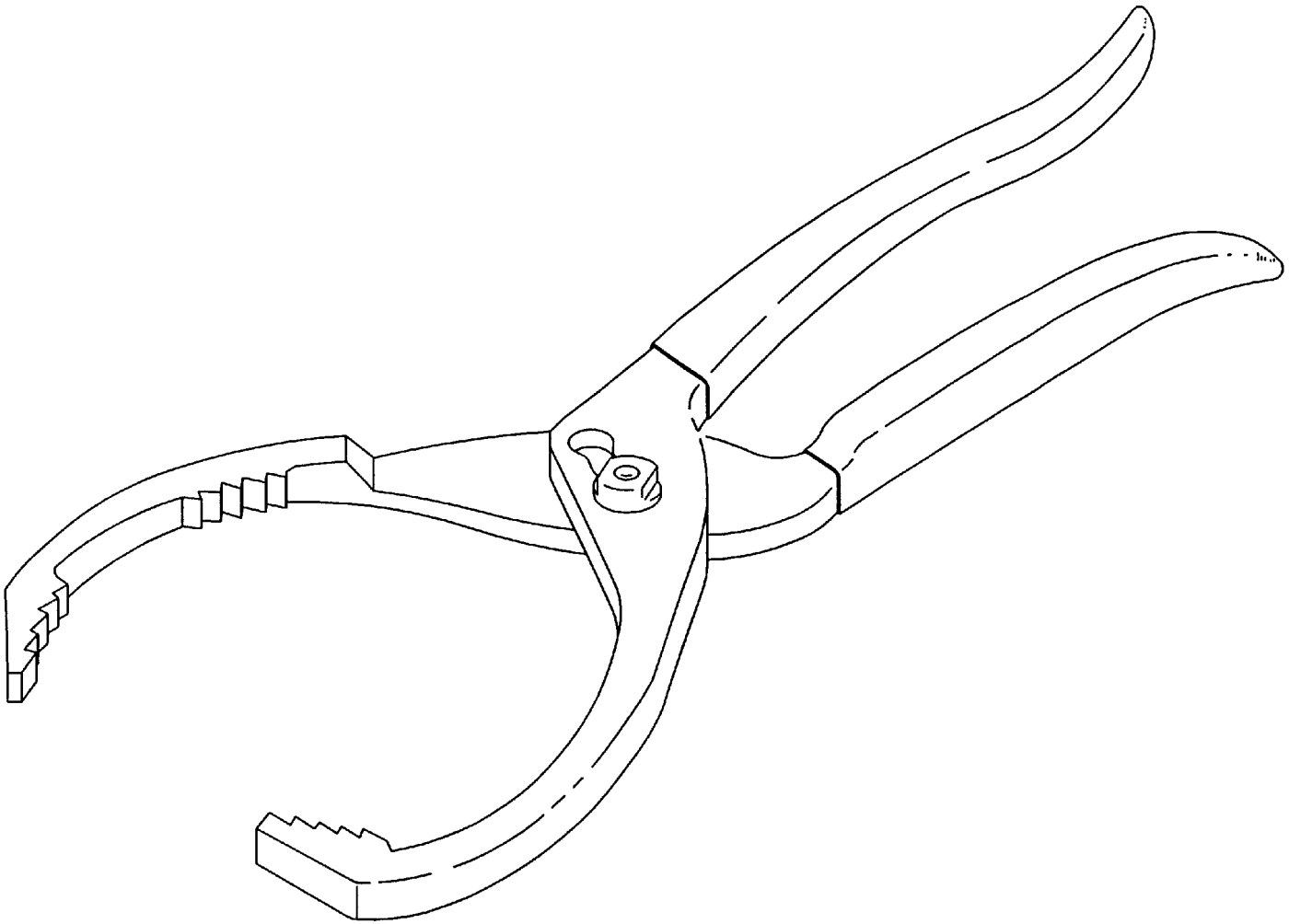
PRIOR ART FIG.2
FIG. 2 is a perspective view of conventional pliers with an extended nose.
Figure 3:
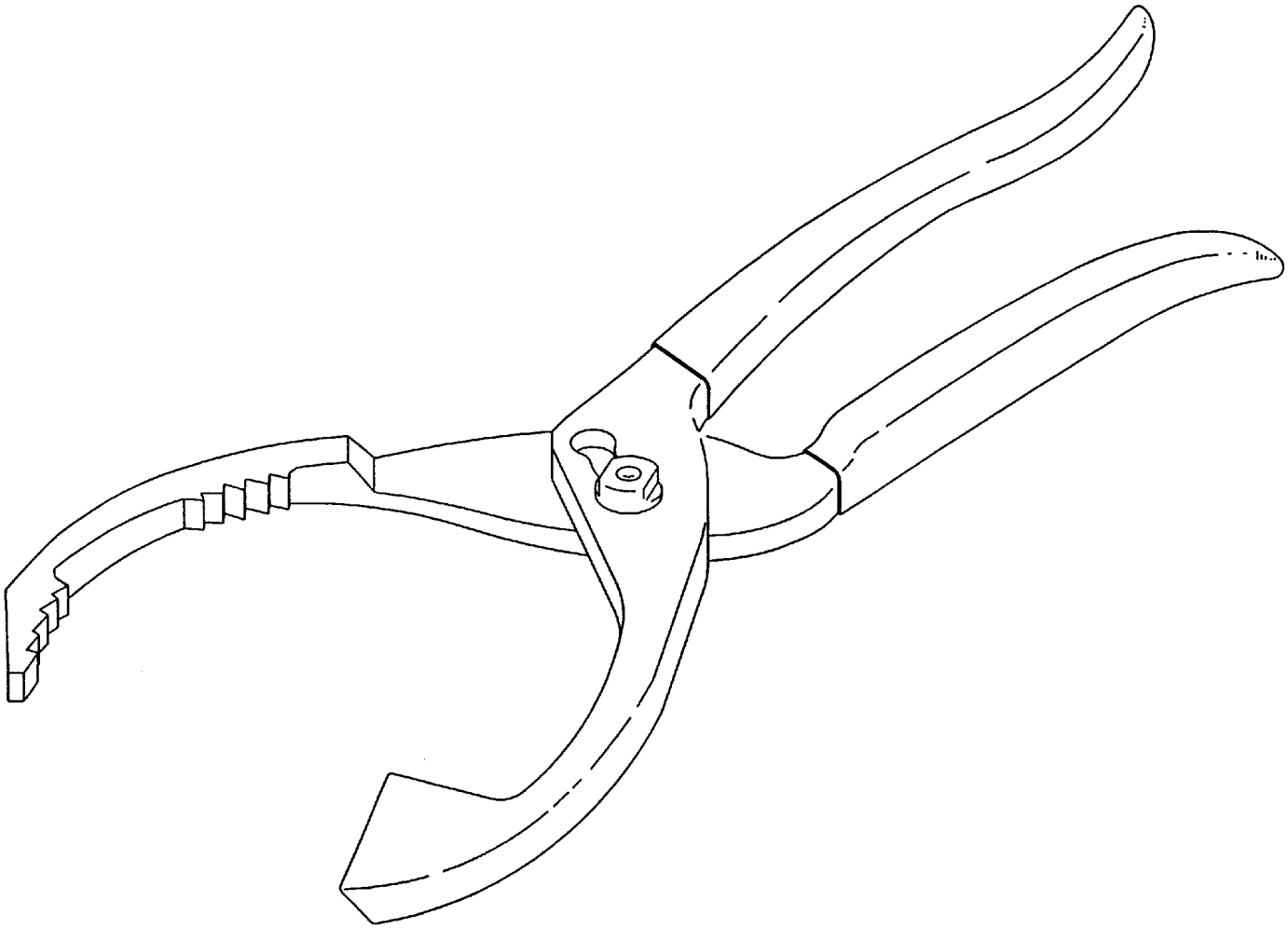
PRIOR ART FIG.3
FIG. 3 is a perspective view of another conventional pliers.
Figure 4:
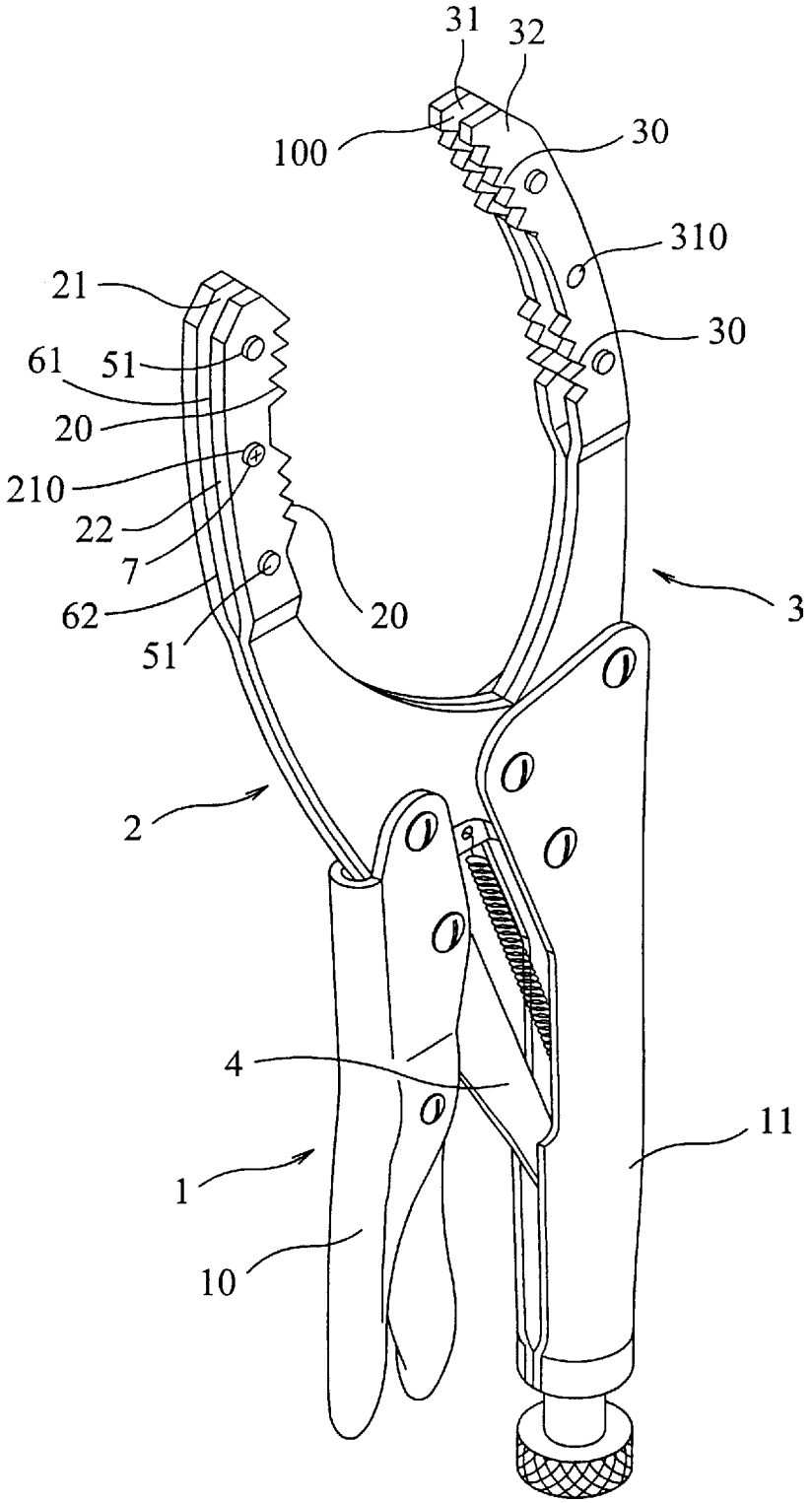
FIG. 4 is a perspective view of the pliers of the present invention.
Figure 5:
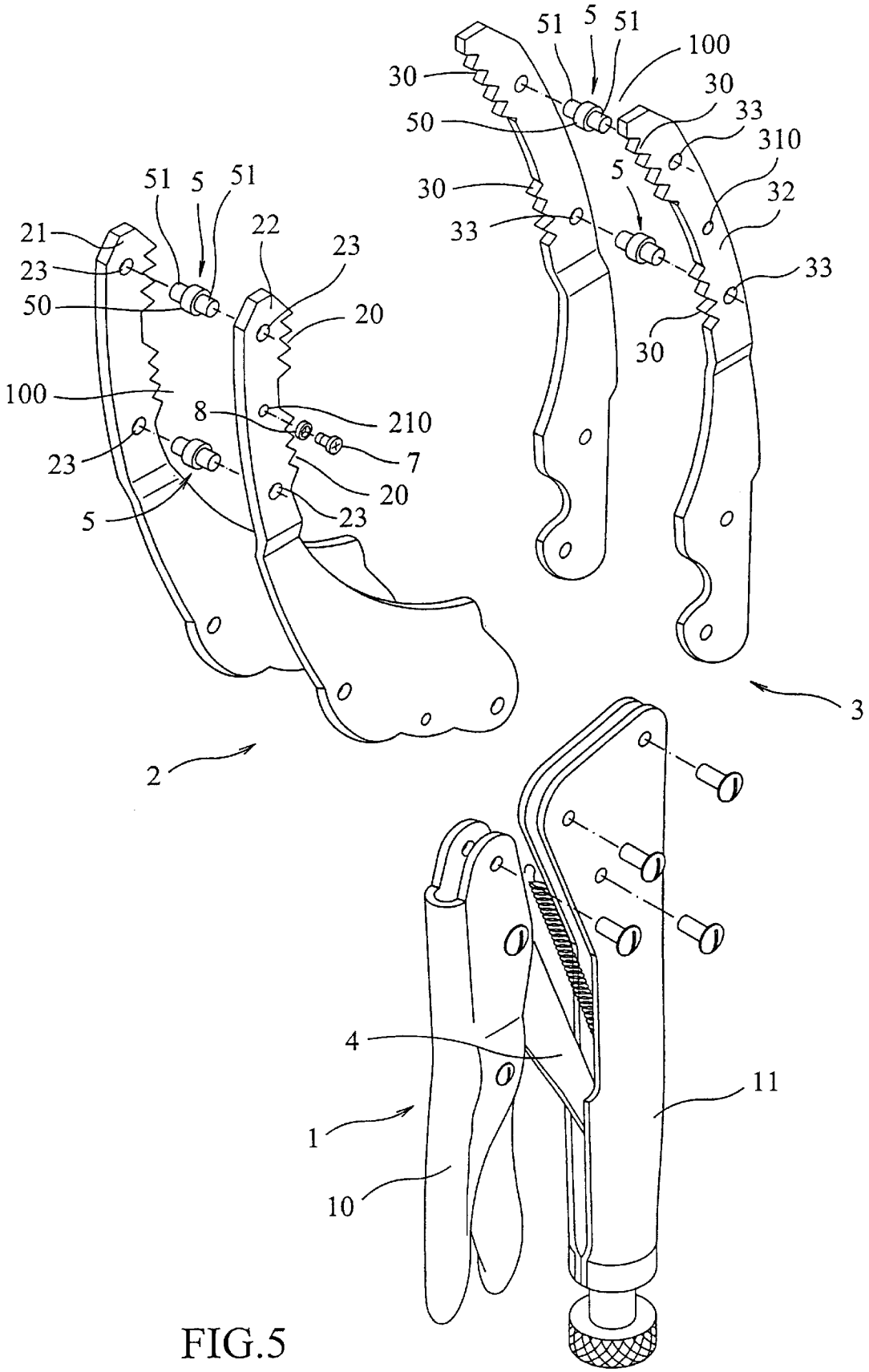
FIG. 5 is a perspective exploded view of the pliers of the present invention.

Referring to FIGS. 4 and 5, there is shown a perspective view of a structure of pliers with variable nose comprising a pliers body 1, two elongated pliers arms 2, 3 riveted with the pliers body 1. Two elongated pliers arms 2, 3, form a large nose. The nose of the elongated pliers arms 2, 3 are linked by the extension and retraction of the two handles 10, 11 of the pliers body 1. The mutual action of the elongated arms 2, 3 allow the gripping of article with large diameter. The locking action of the locking arm 4 between the pliers body 1 together with the moving of one of the elongated pliers arm 2 and the moving handle 10 can position and clip the article with a large diameter.

In accordance with the present invention, the elongated pliers arms 2, 3 and the handles 10, 11 are formed integrally as one unit, and one of the arms is moveably mounted. Thus when one pliers arm 2 is extended and together with the handle 10, the position of the torque point allows the arm 2 to extend in one direction, and thus the two arms 2, 3 are proceeded to extend or retract.

In accordance with the present invention, the curvature of the alms 2, 3 is an arch-shaped surface and the teeth groups 20, 30 are provided along the clipping surface of the inner arch-shaped surface. The corresponding action of the teeth groups 20, 30 can clip onto article of diameter of various sizes.

In one preferred embodiment of the present invention, there are at least 3 teeth groups supporting points among four of teeth groups 20, 30 are used in the clipping process. In other words, when clipping article with different circumference, at least 3 supporting points of the pliers is being used in the mounting action.

The above elongated pliers arms 2, 3 are formed from two identical clipping plates 21, 22 and 31, 32. There are two circular holes 23, 33 being formed at the top and bottom clipping plates 21, 22, 31, 32. The center of the clipping plates 21, 31 and the circular holes 23, 33 are provided with screw holes 210, 310. Two rivets 5 having a top and bottom rivet post 51 are mounted at the two circular holes 23, 33 to form two clipping pliers arms 2, 3 having a hollow space 100 located at the clipping surface of the two identical clipping plates 21, 22, 31, 32.

Figure 6:
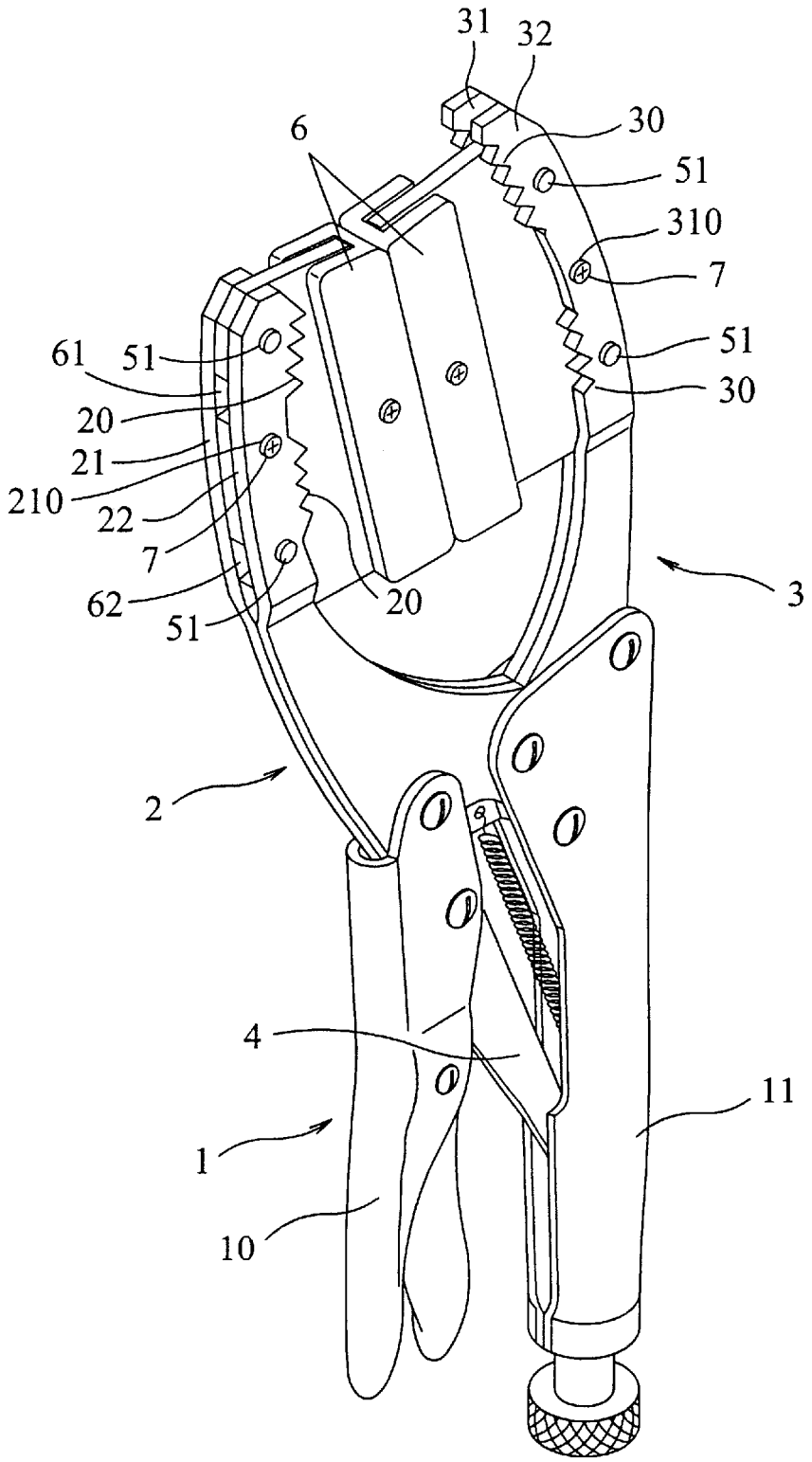
FIG. 6 is a perspective view of the pliers having the nose mounted with a soft tube locking structure of the present invention.
Figure 7:
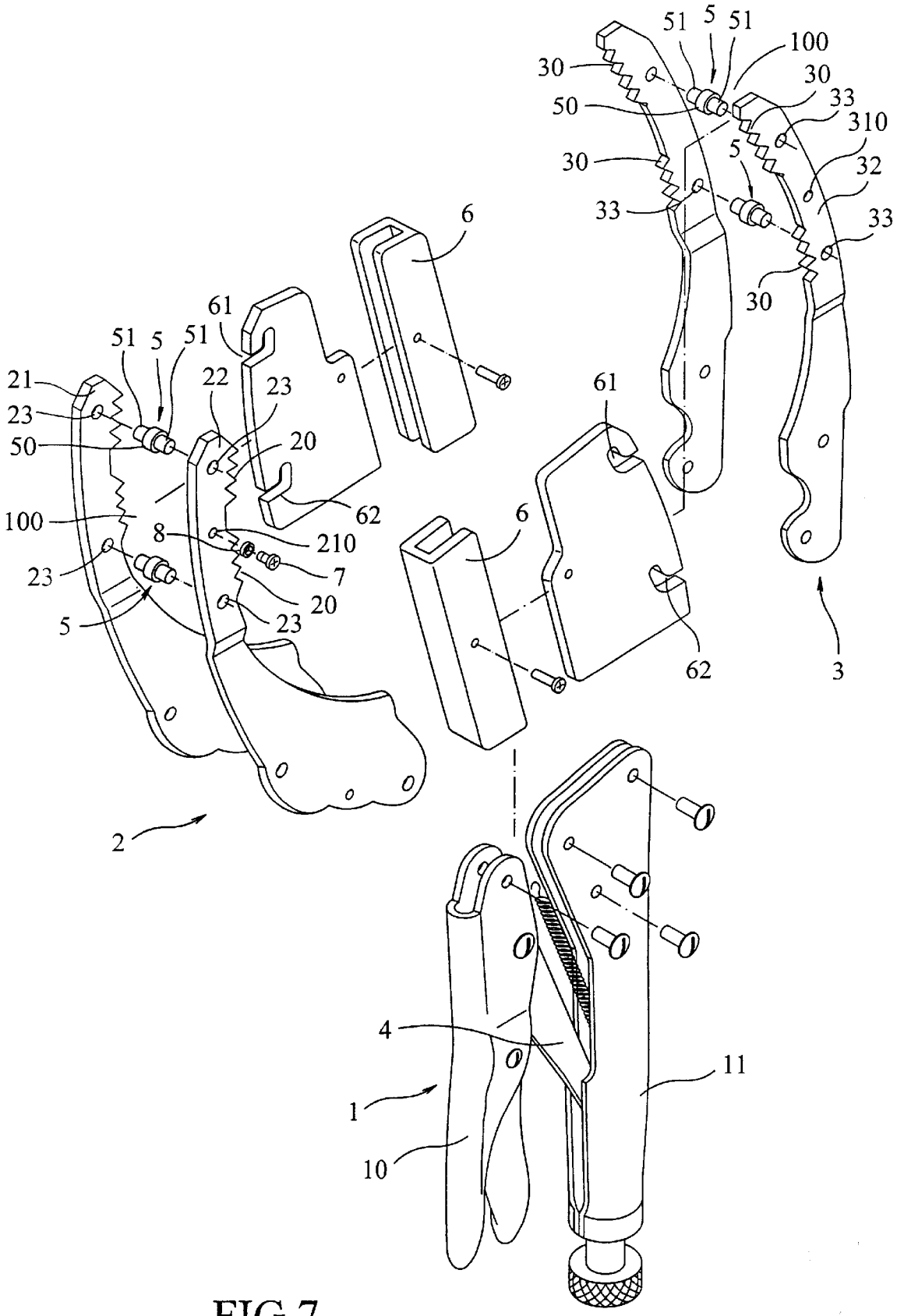
FIG. 7 is a perspective exploded view of the pliers having the nose mounted with a soft tube locking structure of the present invention.

In accordance with the present invention, the two pliers arms 2 and 3 can be mounted with clipping block 6 of various functions (referring to FIGS. 6, 7 for explanation), wherein the clipping surface of the clipping block 6 has a shape based on its function, and the other end face is provided with two recesses 61, 62.

The large post 50 at the center section of the rivet 5 is engaged with the recesses 61, 62 and a pad ring 8 and a bolt 7 are mounted onto the clipping block 6 to form a pliers with multi-function.

Figure 10:
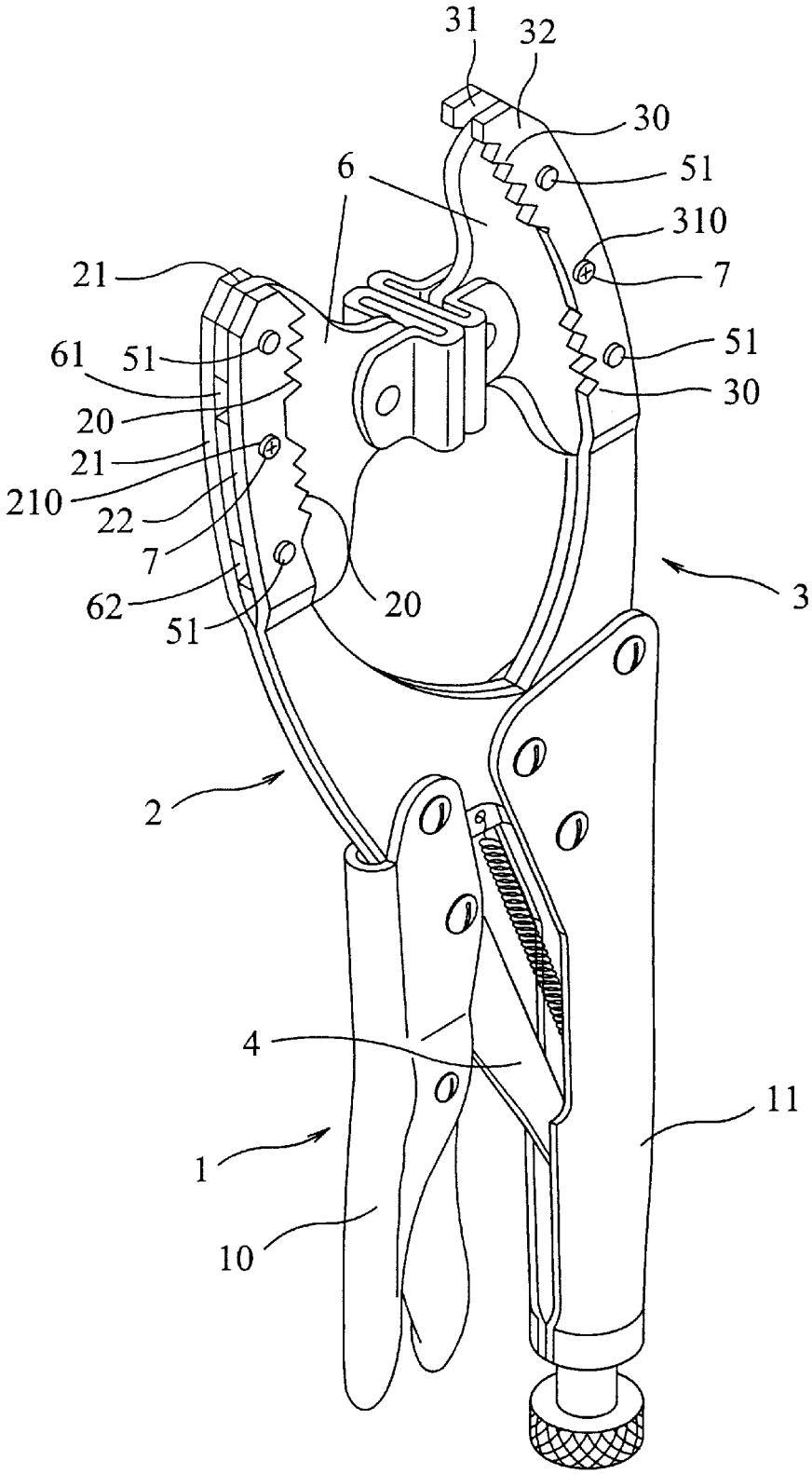
FIG. 10 is a perspective view showing the large nose of the pliers being changed to a flat board clipping nose of the present invention.
Figure 11:
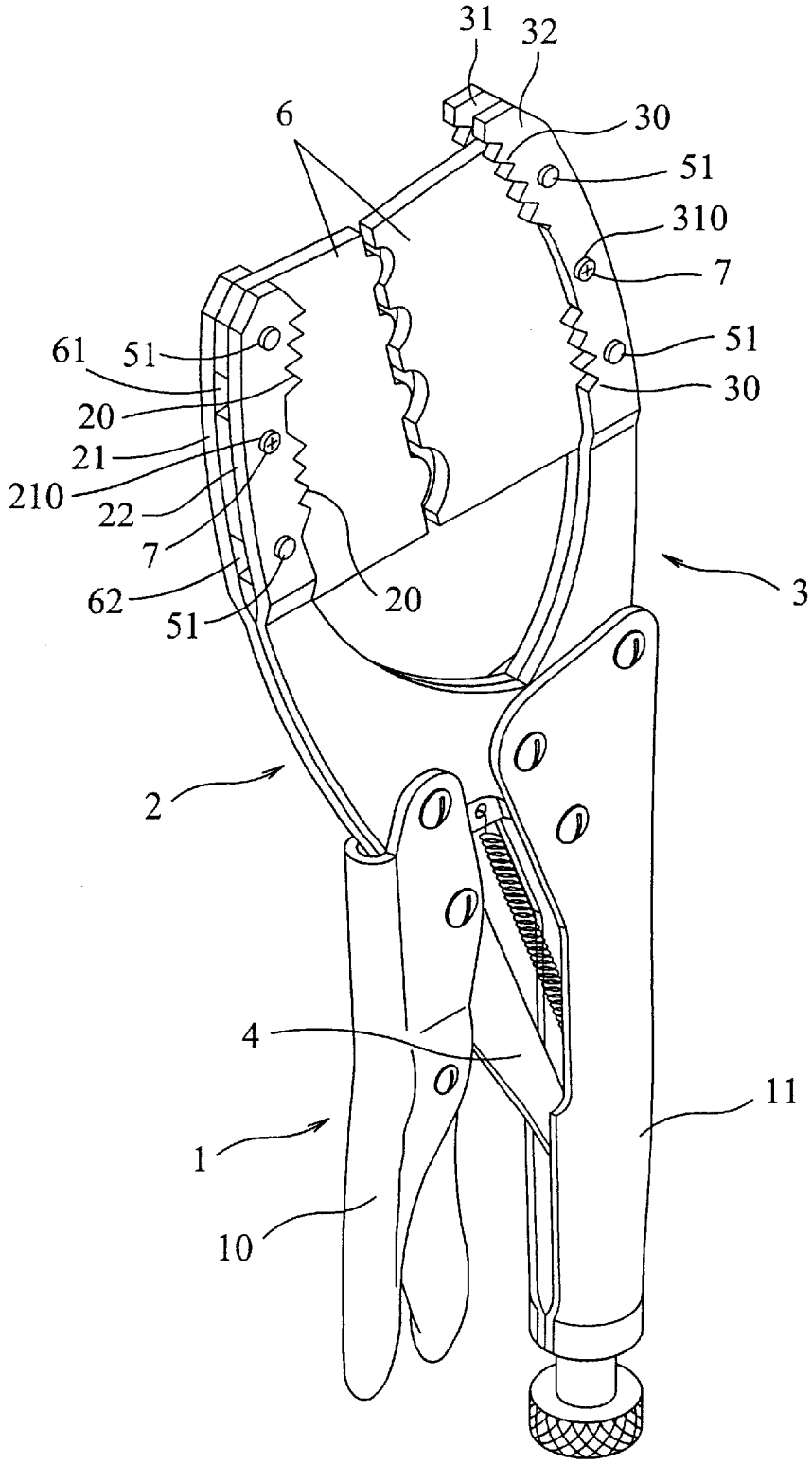
FIG. 11 is a perspective view of the large nose of the pliers being changed to a pincher in accordance with the present invention.
Figure 12:
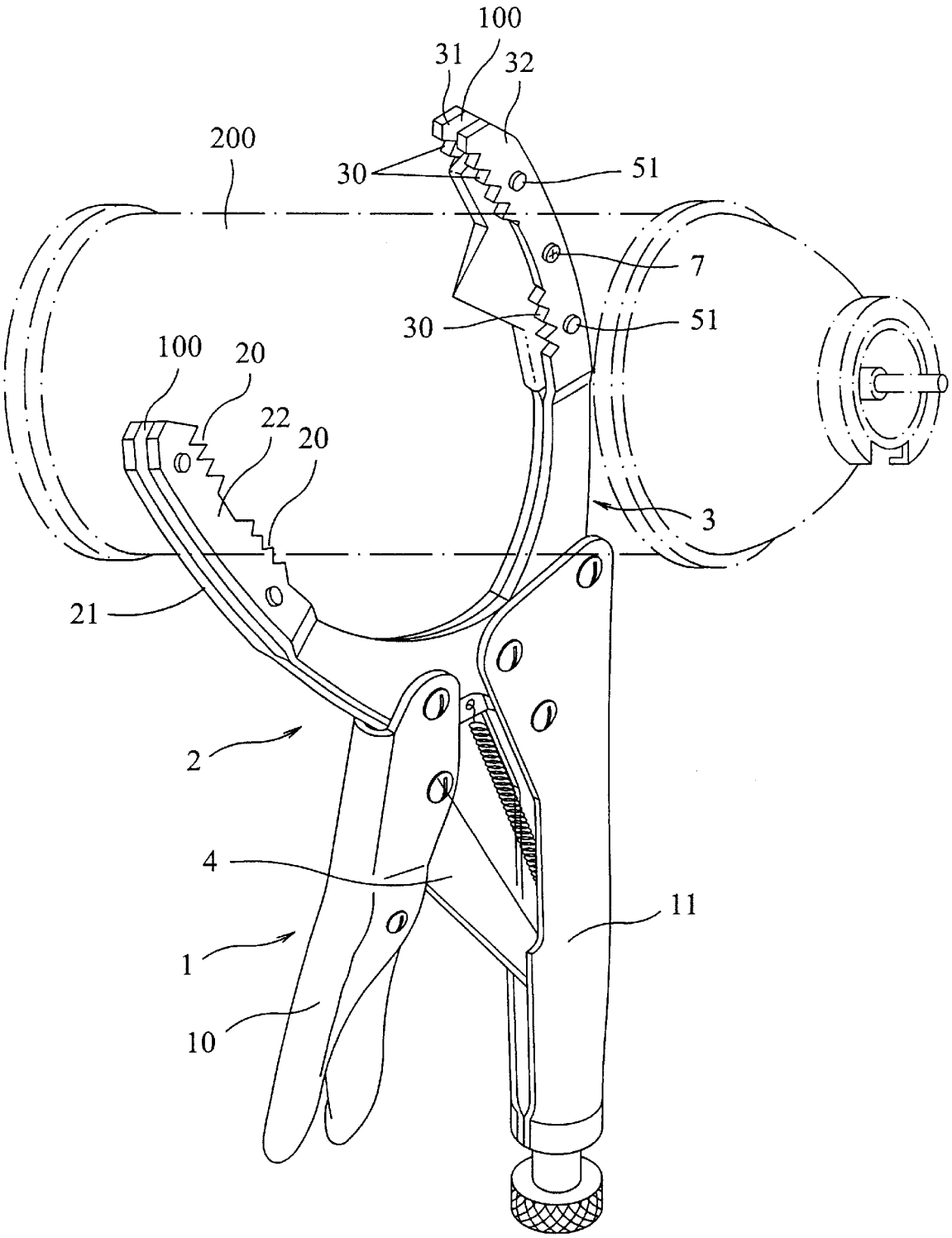
FIG. 12 is a perspective view of the large nose of the pliers being changed to pressurized container pliers in accordance with the present invention.

Referring to FIG. 4, there is shown a large nose pliers, which can associate with clipping block of multiple functions. The clipping block 6 is varied to include a soft tube mounting structure (shown in FIG. 6), a small diameter tube mounting structure (shown in FIG. 9), flat board mounting structure (shown in FIG. 10), pincher (shown in FIG. 11), a pressurized container mounting structure (shown in FIG. 12).

Figure 9:
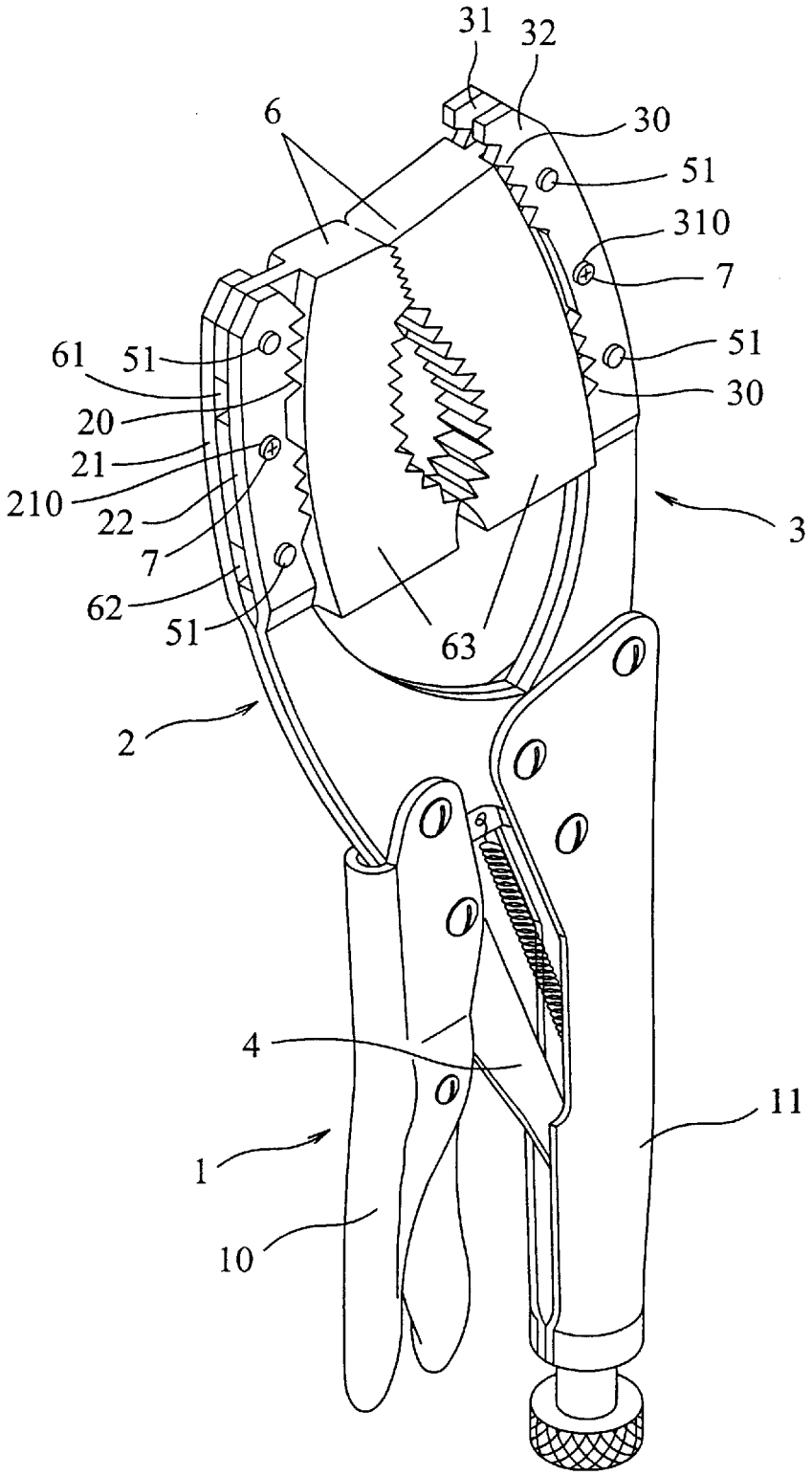
FIG. 9 is a perspective view showing the large nose of the pliers being changed to a small nose of the present invention.

FIG. 9 shows the structure of a small diameter tube pliers, wherein the large nose of the elongated arms 2, 3 is in associated with a clipping block 6. At this instance, an urging end portion 63 is mounted to the flat surface of the clipping block 6. The urging end portion 63 is a reinforcing element.

Figure 8:
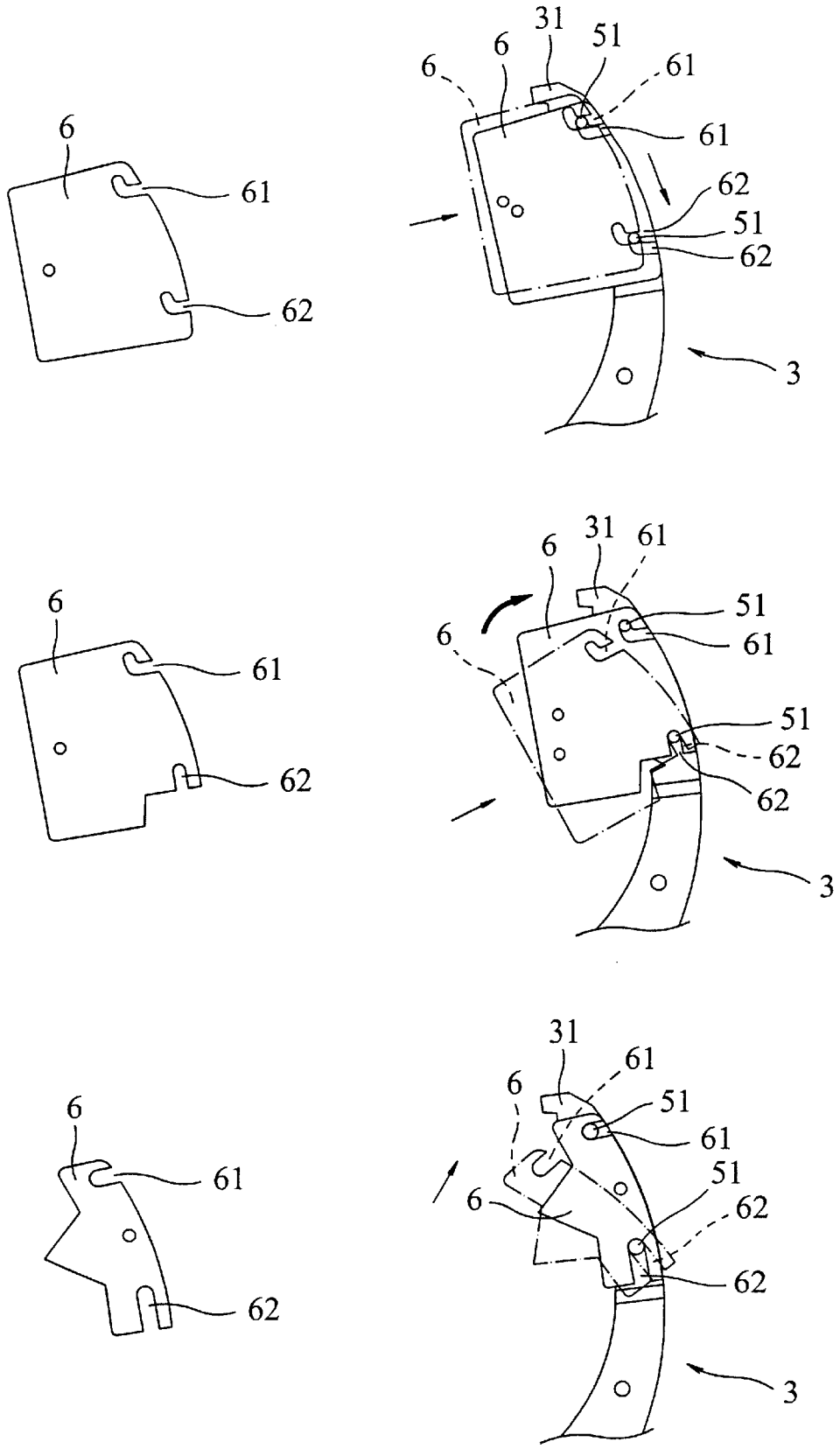
FIG. 8 is a schematic view showing the mounting of the clipping blocks onto the nose of the arms of the pliers.

As shown in FIG. 8, the two recesses 61, 62 can be formed into various, shapes and structure recesses in order to achieve securing.

Figure 13:
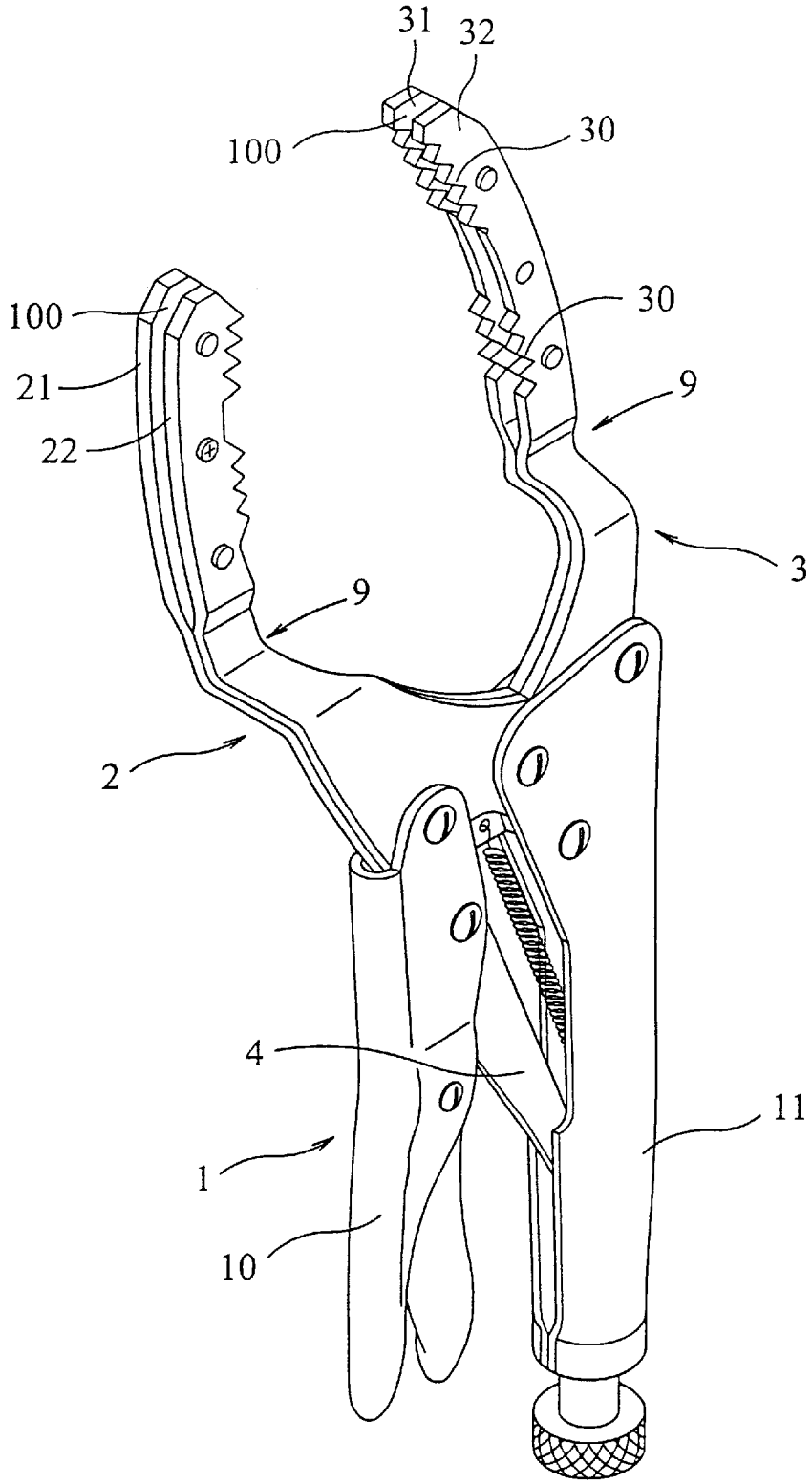
FIG. 13 is a perspective view of the structure of the pliers with two large noses structure of the present invention.
Figure 14:
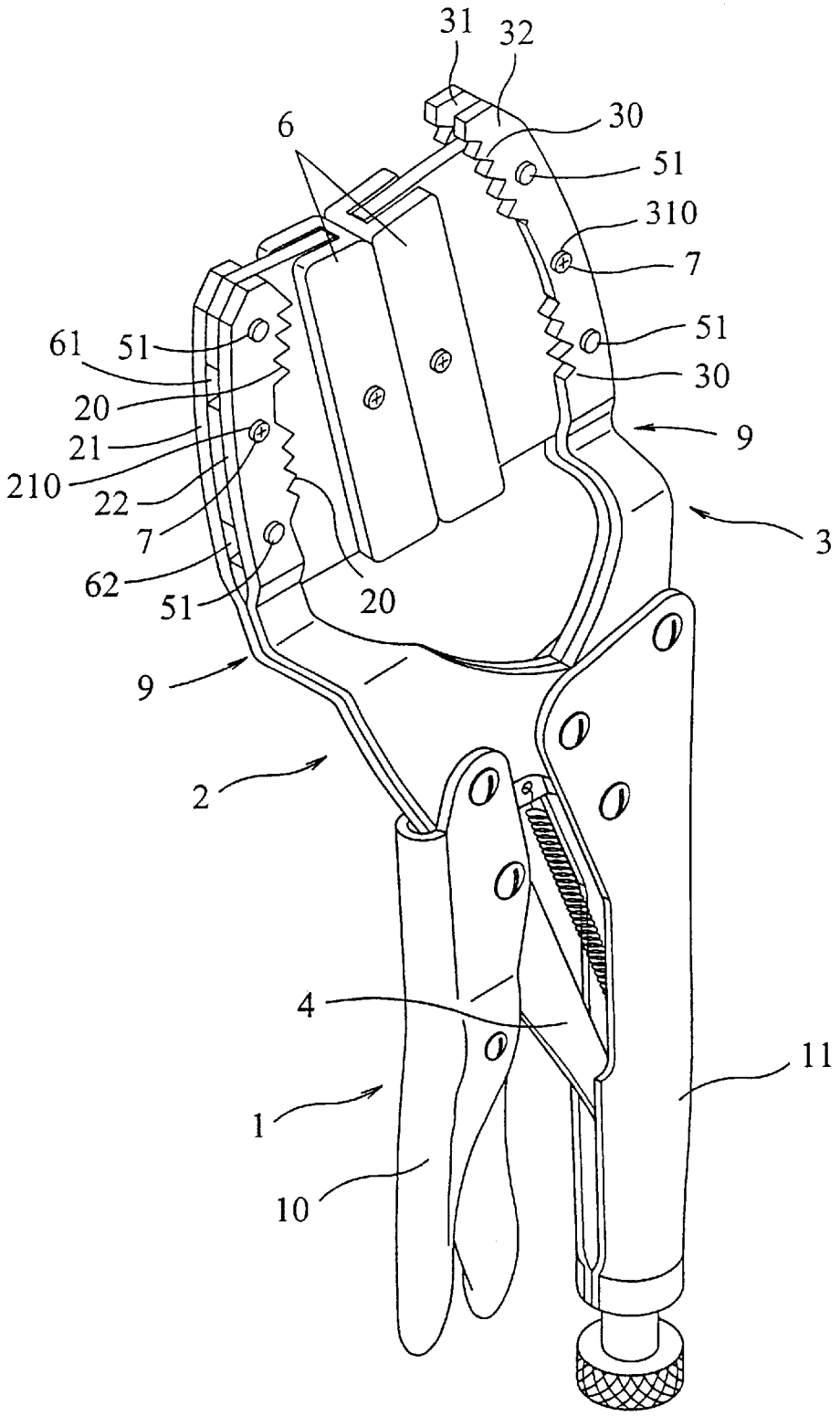
FIG. 14 is a perspective view of the structure of the pliers with two large noses structure being mounted with a soft-tube tightening structure of the present invention.

Referring to FIG. 13, the identical clipping plates 21, 22, 31, 33 are bi-directional bending, and the two arms 2, 3 of the bi-directional bending 9 is parallel to the pliers body 1.

FIG. 13 shows a pliers structure with two large noses. The pliers arms 2, 3 can mount with the clipping block 6 to provide various functions.

While the invention has been described with respect to preferred embodiments, it will be clear to those skilled in the art that modifications and improvements may be made to the invention without departing from the spit and scope of the invention. Therefore, the invention is not to be limited by the specific illustrative embodiment, but only by the scope of the appended claims.

I claim:

1. A structure of pliers with variable nose comprising a pliers body, two elongated arms being formed with the pliers body to form a large nose pliers, wherein the two elongated arms are mounted with rivets at a top section of the pliers body and the elongated arms comprise two identical shape clipping plates each having a clipping face and two symmetrical holes so that the rivets can be mounted thertrough to form into two clipping arms, wherein each of said clipping faces is provided with two groups of teeth and various types of clipping blocks with two recesses which are mounted on said rivets within a space formed by the two clipping plates and secured with a bolt.

2. The structure of pliers with variable nose as set forth in claim 1, wherein the two recesses of the clipping blocks have different shapes to facilitate securing.

3. The structure of pliers with variable nose as set forth in claim 1, wherein each of said clipping blocks includes two flat surfaces provided with an urging end section to reinforce a loading force of the pliers.

4. The structure of pliers with variable nose as set forth in claim 1, wherein the clipping plates are a bi-directional bending and the clipping arms and the plier's body are straight, parallel and alternately arranged structure.

* * * * *